US006252824B1

(12) United States Patent
Ogasawara

(10) Patent No.: US 6,252,824 B1
(45) Date of Patent: Jun. 26, 2001

(54) ELECTRONIC TIME PIECE WITH A BEARING DETECTOR

(75) Inventor: Kenji Ogasawara, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/516,992

(22) Filed: Mar. 1, 2000

(30) Foreign Application Priority Data

Mar. 12, 1999 (JP) ..... 11-066469

(51) Int. Cl.[7] ..... G04B 47/00
(52) U.S. Cl. ..... 368/10; 368/11; 368/14
(58) Field of Search ..... 368/10, 11, 14, 368/15; 33/263, 333, 334, 354, 356, 357

(56) References Cited

U.S. PATENT DOCUMENTS 4,337,530 * 6/1982 Toft ..... 368/62
4,482,255 * 11/1984 Gygax et al. ..... 368/10
5,175,936 * 1/1993 Sato ..... 33/354
5,216,816 * 6/1993 Ida ..... 33/356
5,600,611 * 2/1997 Kamens ..... 368/10
5,883,861 * 3/1999 Moser et al. ..... 368/10

* cited by examiner

*Primary Examiner*—Vit Miska
(74) *Attorney, Agent, or Firm*—Adams & Wilks

(57) ABSTRACT

An electronic timepiece has an oscillating circuit for producing a clock signal. A dividing circuit divides the clock signal and produces a divided output signal used to count elapsed time. A calculating circuit calculates time information in accordance with the divided output signal produced by the dividing circuit. A detecting circuit detects a horizontal state of the electronic timepiece relative to a ground reference. A bearing measurement device measures bearing information when a horizontal state of the electronic timepiece relative to the ground reference is detected by the detecting circuit. A display circuit displays time information calculated by the calculating circuit and displays bearing information measured by the bearing measurement circuit.

26 Claims, 7 Drawing Sheets

ELECTRONIC TIME PIECE WITH A BEARING DETECTOR

BACKGROUND OF THE INVENTION

1. Field of the Invention

The present invention relates to an electronic timepiece, such as a wrist watch, with a bearing detector and, more particularly, to an electronic watch with a bearing detector for performing of starting and ending operations bearing measurement.

2. Description of the Prior Art

A conventional electronic wrist watch with a bearing detector, as shown, for example comprise by a block diagram in FIG. 7, comprise a microprocessor (CPU) 10, a memory (ROM) 11 for storing a system program, processing program and the like for the CPU 10, a memory (RAM) 12 for storing processing data and the like, an oscillation circuit 13 for providing a clock signal to the CPU 10, a display circuit 14 driven by the CPU 10 for performing time display, bearing measurement value display and the like, a bearing detection circuit 15 controlled by the CPU 10 for performing bearing measurement, a frequency-dividing circuit 16 for frequency-dividing an oscillation frequency of the oscillation circuit 13 and generating a 1-Hz timing signal, a push button 17 for starting bearing measurement and an interrupt circuit 18.

Although the electronic wrist watch with a bearing detector is usually utilized by wearing on the arm, a wearer has been required to press a measurement push button 17 when starting bearing measurement. The wearer fully understands that measurement with the electronic wrist watch with a bearing detector positioned in a horizontal state is suited for bearing measurement. However, there are often cases that the push button 17 is pressed in a state that the electronic wrist watch with an bearing detector is not horizontal but inclined. If bearing measurement is made by the electronic wrist watch with a bearing detector in such an inclined state, there is a problem that the measurement accuracy is decreased.

The problem that the present invention is to solve is to improve bearing measurement accuracy by automatically starting bearing measurement when an electronic wrist watch with a bearing detector becomes is positioned a horizontal state.

SUMMARY OF THE INVENTION

In order to solve the above problem in the conventional art, an electronic watch with a bearing detector comprises a microprocessor, a memory for storing a processing program, processing data and the like for the microprocessor, an oscillation circuit for providing a clock signal to the microprocessor, a display circuit driven by the microprocessor to perform time display, bearing measurement value display and the like, and a bearing detection circuit controlled by the microprocessor to perform bearing measurement, wherein when a horizontal detection circuit detects a horizontal state of the electronic wrist watch with a bearing detector, bearing measurement and bearing measurement value display are performed.

According to the present invention, bearing measurement is started by detecting a horizontal state of the electronic wrist watch with a bearing detector relative to a ground reference by the horizontal detection circuit and is continued until a measurement stop signal is inputted. Further, the measurement stop signal can be inputted manually by pressing a push button or automatically after counted a predetermined time period counted by a timer has elapsed.

BRIEF DESCRIPTION OF THE DRAWINGS

A preferred form of the present invention is illustrated in the accompanying drawings in which:

FIGS. 5A–5D are figures showing one example of a horizontal sensor used in the horizontal detection circuit, wherein FIG. 5A is a perspective view, FIG. 5B is a longitudinal sectional view in a horizontal state, FIG. 5C is a longitudinal sectional view in an inclined state, and FIG. 5D is a plan view in an inclined state shown with a lid removed;

DETAILED DESCRIPTION OF THE PREFERRED EMBODIMENTS

Figure 7:
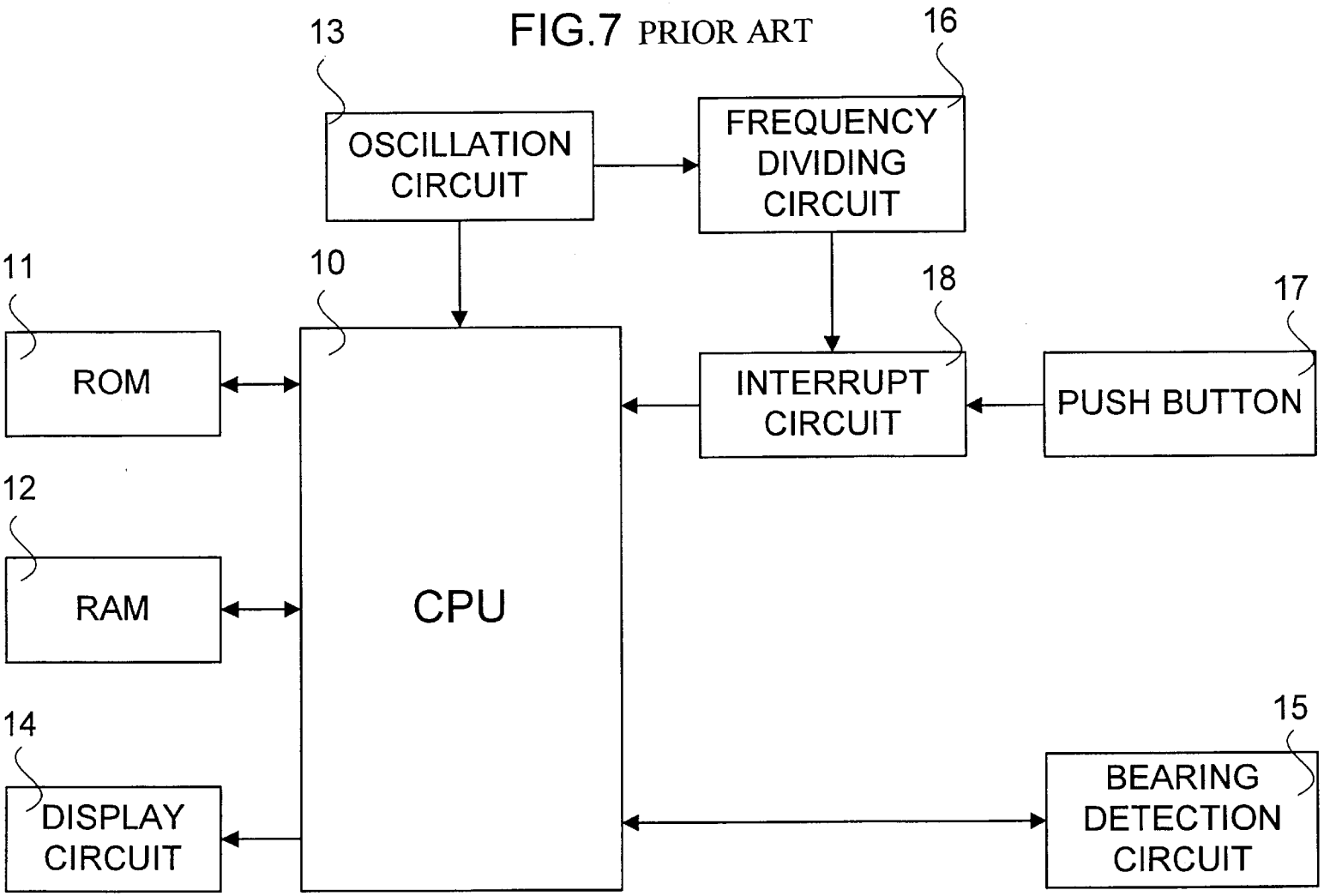
FIG.7 PRIOR ART
FIG. 7 is a block diagram showing a structure of a conventional electronic wrist watch with a bearing detector.

One embodiment of a electronic wrist watch with an bearing detector of the present invention is basically structured by adding to a conventional apparatus shown in FIG. 7 means for obtaining a bearing measurement (i.e., detecting a predetermined azimuth on the earth, and for displaying a bearing measurement value when a horizontal state of the electronic wrist watch with a bearing detector.

Figure 1:
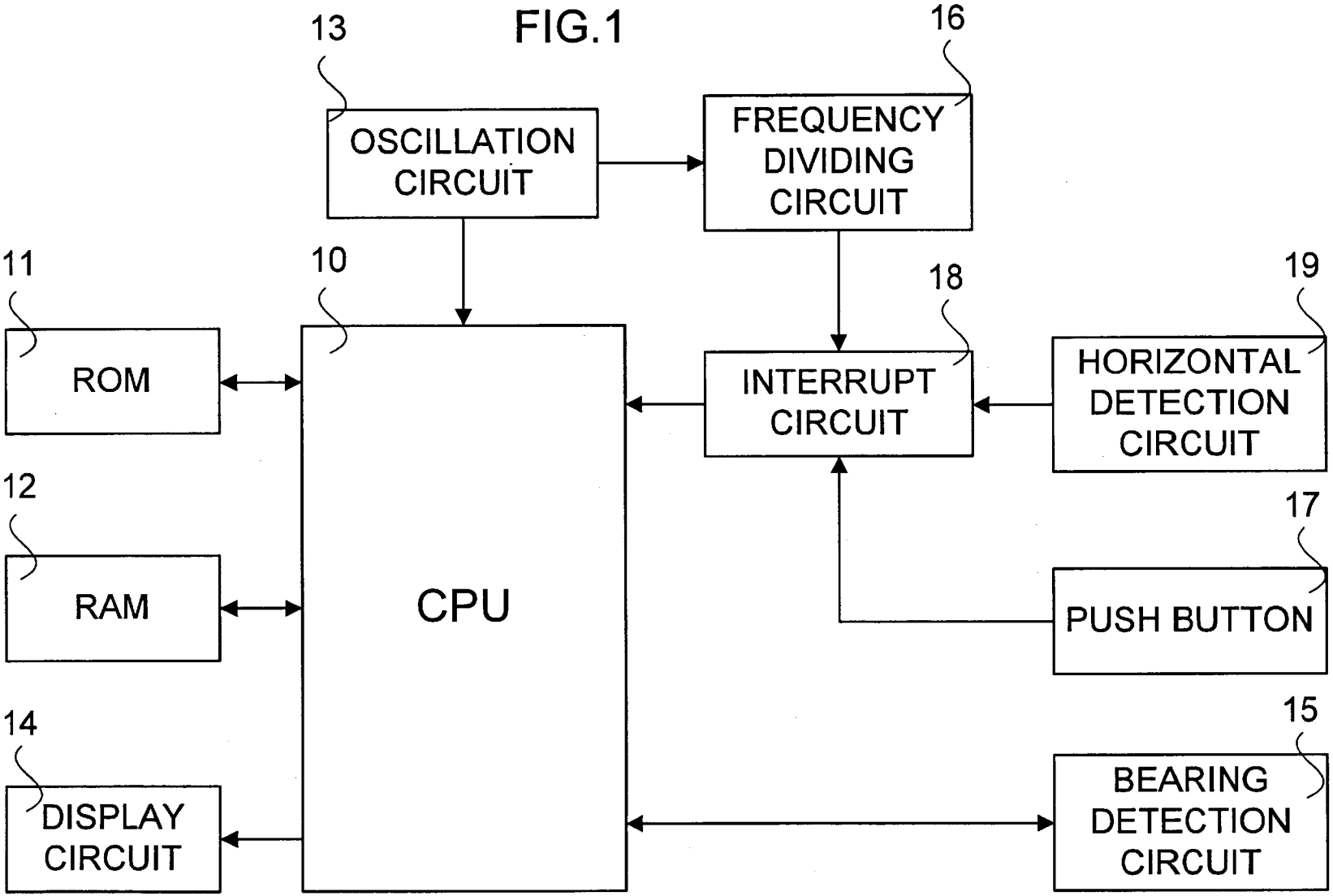
FIG. 1 is a block diagram showing a structure of one embodiment of the present invention.

That is, as shown in a block diagram of FIG. 1, the one embodiment of an electronic wrist watch with a bearing detector is structured by a microprocessor (CPU) 10, a memory (ROM) 11 for storing a system program, processing program and the like for the CPU 10, a memory (RAM) 12 for storing processing data and the like, an oscillation circuit 13 for providing a clock signal to the CPU 10, a display circuit 14 driven by the CPU 10 and performing time display, bearing measurement value display and the like, a bearing detection circuit 15 controlled by the CPU 10 for performing bearing measurement, a frequency-dividing circuit 16 for frequency-dividing an oscillation frequency and generating a 1-Hz timing signal, a push button 17, an interrupt circuit 18 and a horizontal detection circuit 19 for generating a horizontal detection signal. The interrupt circuit 18 inputs a timing signal from the frequency-dividing circuit 16, a bearing measurement stop signal from the push button 17 and a horizontal detection signal from the horizontal detection circuit 19, respectively, to the CPU 10. The bearing measurement stop signal can be generated by a timer, as hereinafter described.

The horizontal detection circuit 19 is arranged within a case of the electronic wrist watch with a bearing detector or attached to the case. Consequently, the horizontal detection circuit 19 generates a horizontal detection signal when the electronic wrist watch with a bearing detector is positioned in a horizontal state, and provides it to the interrupt circuit 18. The interrupt circuit 18 allows this horizontal detection signal to input to the CPU 10. The horizontal detection circuit 19 is provided with a horizontal sensor 20 as described below.

The horizontal sensor 20 is comprised, for example as shown in a perspective view 5A, longitudinal sectional views 5B and 5C and a plan view with a lid removed 5D of FIGS. 5, a circular container 21 of an insulation material having a generally-cylindrical interior chamber 21*a,* two conductive strip members 24*a* and 24*b* arranged within the circular container 21 to function as a pair of fixed contacts, and a conductive spherical member 25 enclosed in the circular container 21 to function as a movable contact.

The circular container 21 is formed by a cup-formed lid member 22 and a dish-formed bottom member 23. The dish-formed bottom member 23 is formed by a conical surface 23*a* opened at a center with a small hole 23*c* and a horizontal surface 23*b* provided on an outer side thereof. The two conductive strip members 24*a* and 24*b* have respective outer ends projecting outside the container 21 to function as a pair of terminals, and respective inner ends thereof extend to ends of small hole 23*c* of the bottom member 23 to function as a pair of fixed contacts. The two conductive strip members 24*a* and 24*b* at surfaces are exposed in the generally-cylindrical interior chamber 21*a* and buried in the bottom member 23. The conductive spherical member 25 functioning as a movable contact is enclosed within the generally-cylindrical interior chamber 21*a* of the container 21 so that it can freely rotate and move according to gravity.

Figure 5A:
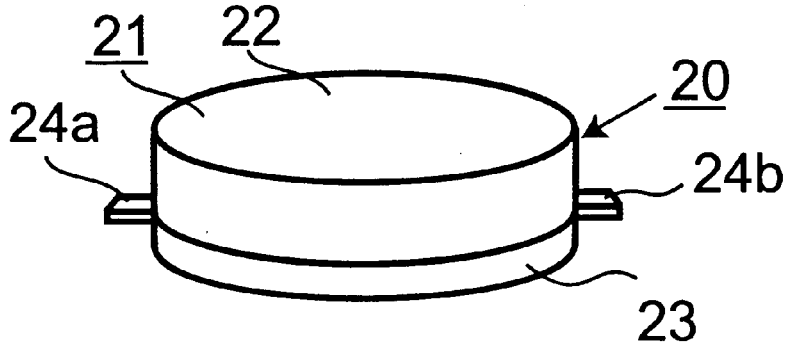
Figure 5B:
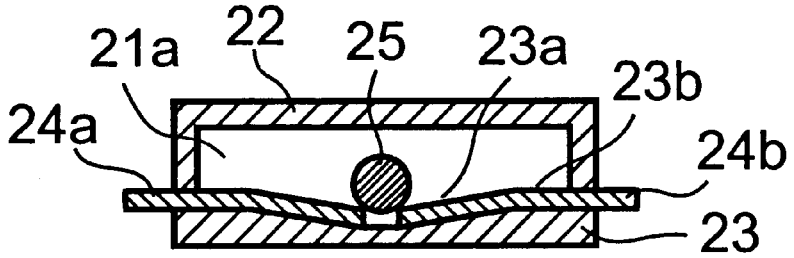
Figure 5C:
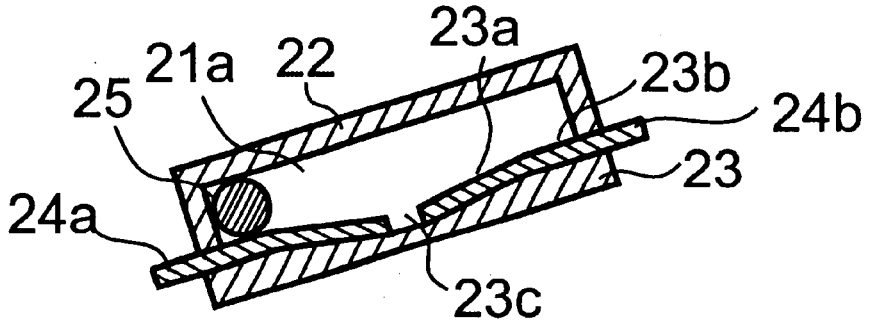
Figure 5D:
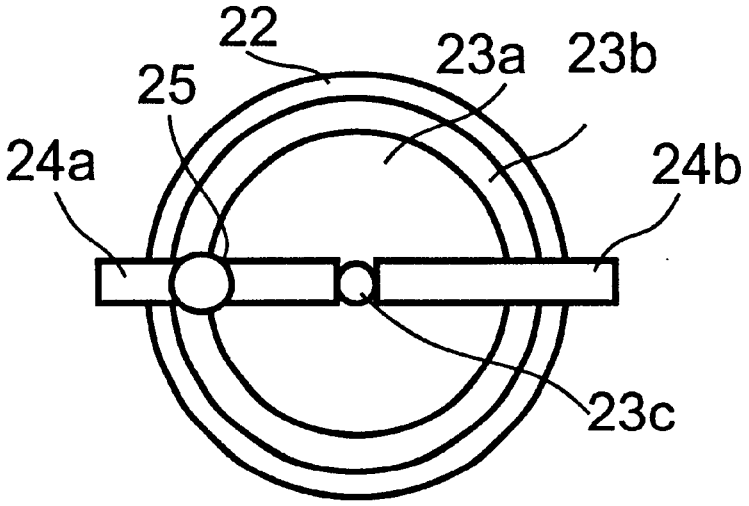

When the horizontal sensor 20 is positioned in a horizontal state relative to the ground, as shown in FIG. 5B, the conductive spherical member 25 moves to and seats on the small hole 23*c* in the center of the bottom member 23, and electrically connects between the paired inner ends of the two conductive strip members 24*a* and 24*b*. When the horizontal sensor 20 is inclined from a horizontal state and if inclined left for example, then as shown in FIGS. 5C and 5D the conductive spherical member 25 leaves from the center small hole 23*c* of the bottom member 23 and moves to an end of the generally-cylindrical interior chamber 21*a* of the container 21, thus electrically disconnecting the paired inner ends of the two conductive strip members 24*a* and 24*b*. In this manner, the horizontal sensor 20 electrically detects a horizontal state.

Figure 2:
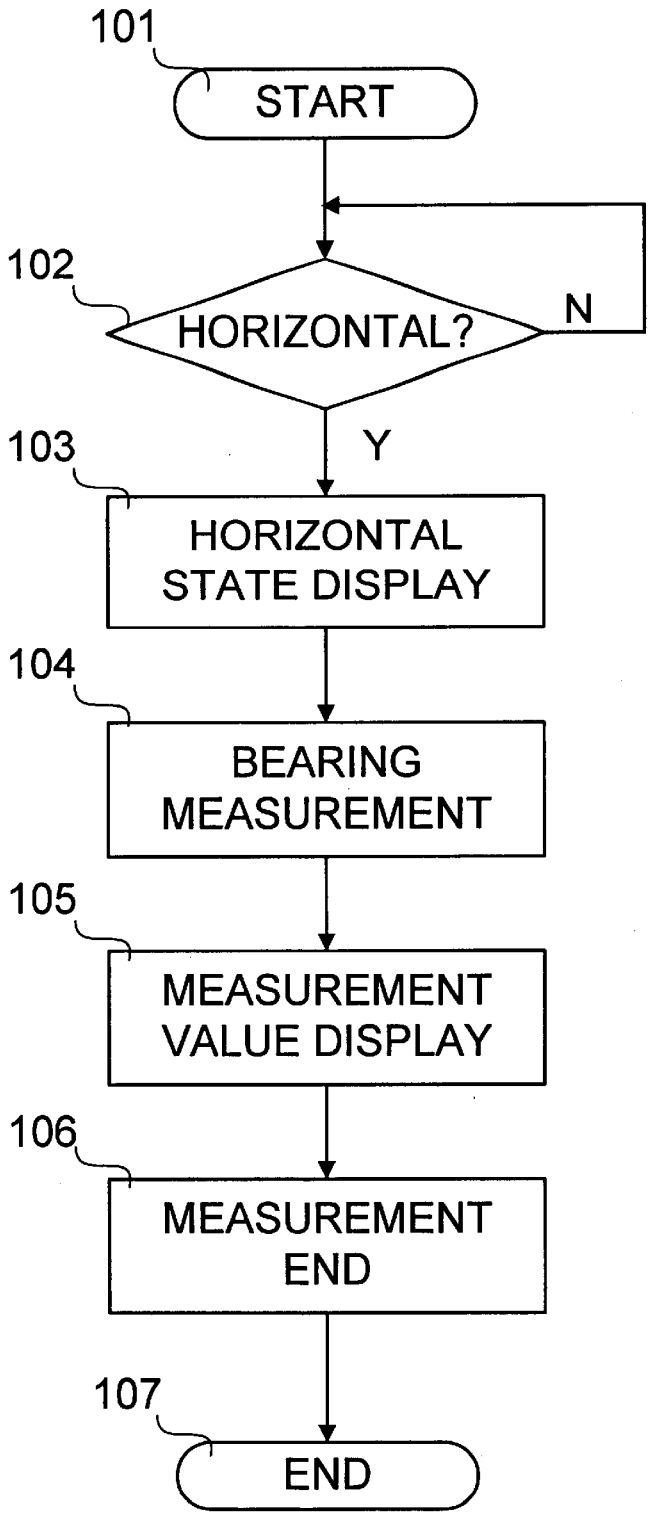
FIG. 2 is a basic flowchart of bearing measurement in the invention.

In the one embodiment apparatus of the invention structured as explained above, the operation from start to end of bearing measurement will be explained with reference to FIG. 2 to FIG. 4. FIG. 2 is a basic flowchart of a bearing measurement operation from start to end, FIG. 3 is a flowchart of a bearing measurement operation which ends automatically after lapse of a predetermined time and, FIG. 4 is a flowchart of a bearing measurement operation which ends when a push button is manually pressed.

In FIG. 2, if the electronic wrist watch with a bearing detector is rendered in a bearing measurement mode, the horizontal detection circuit 19 starts operation (101). When the horizontal detection circuit 19 detects a horizontal state, it provides a horizontal detection signal to the interrupt circuit 18. The interrupt circuit 18 inputs the horizontal detection signal to the CPU 10. Thereupon, the CPU 10 determines that the electronic wrist watch with a bearing detector has been positioned in a horizontal state (102) relative to the ground and drives the display circuit 14 to perform horizontal state display (103). Next, the CPU 10 drives the bearing detection circuit 15 to perform bearing measurement (104) and further drives the display circuit 14 to make a bearing measurement value display (105). Completing the bearing measurement value display, the CPU 10 ends the horizontal detection, bearing measurement and measurement value display (106). The series of operations are executed according to a content of a program stored in the ROM 11. In this manner, the electronic wrist watch with a bearing detector in a bearing measurement mode automatically starts bearing measurement if positioned in a horizontal state.

Figure 3:
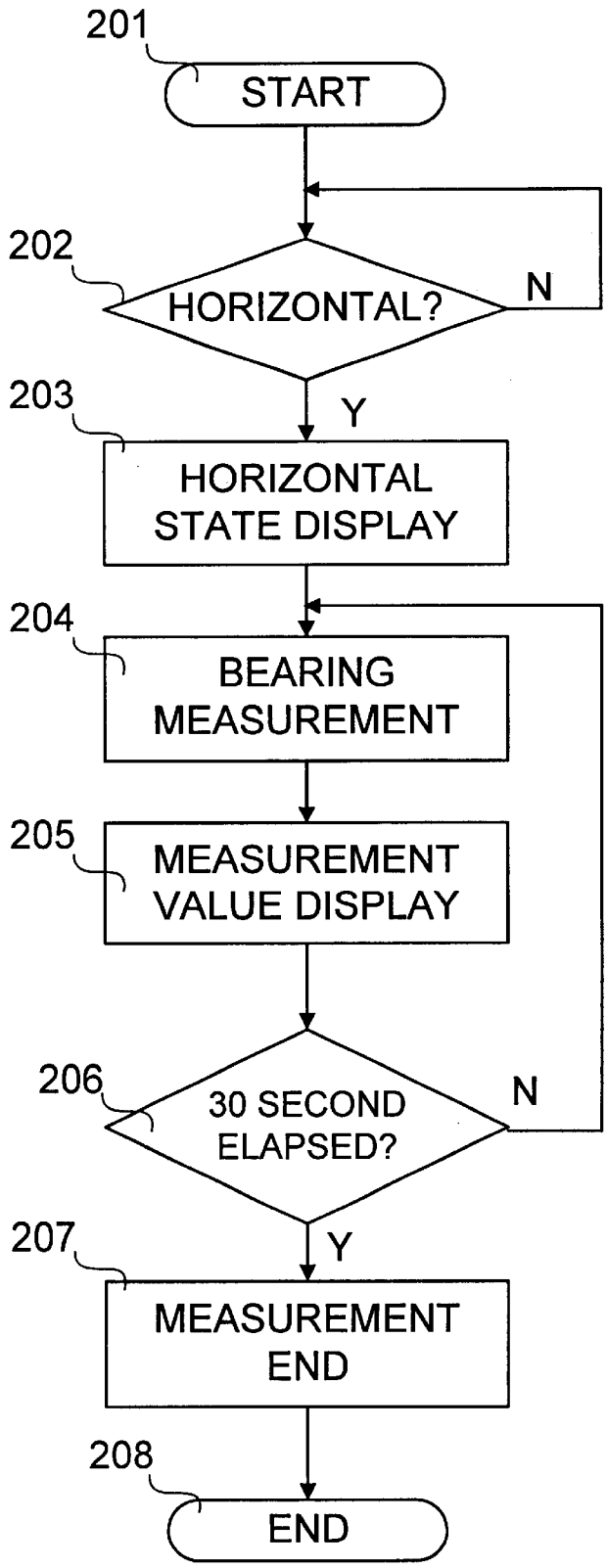
FIG. 3 is a flow chart of bearing measurement from a start to an end due to elapsing a predetermined time period in the present invention.
Figure 4:
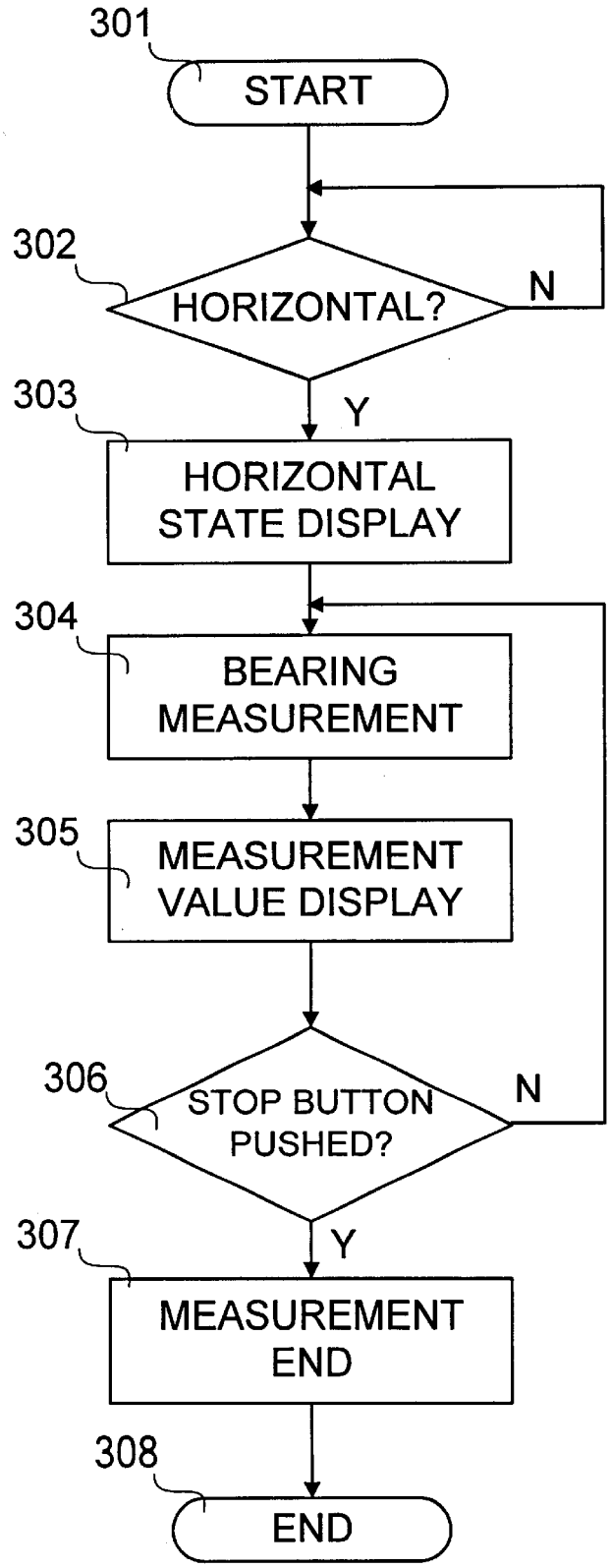
FIG. 4 is a flow chart of bearing measurement from a start to an end by pressing push button in the present invention.

In FIG. 3, if the electronic wrist watch with a bearing detector is rendered in a bearing measurement mode, the horizontal detection circuit 19 starts operation (201). The horizontal detection circuit 19 if detecting a horizontal state, provides a horizontal detection signal to the interrupt circuit 18. The interrupt circuit 18 inputs the horizontal detection signal to the CPU 10. Thereupon, the CPU 10 determines that the electronic wrist watch with a bearing detector has been positioned in a horizontal state (202) and drives the display circuit 14 to make horizontal state display (203). Next, the CPU 10 drives the bearing detection circuit 15 to perform bearing measurement (204) and further drives the display circuit 14 to perform bearing measurement value display (205). Subsequently, the CPU 10 determines whether or not 30 seconds has passed from a start of bearing measurement (206) and, if not elapsed by 30 seconds, continues the bearing measurement and measurement value display. In the case that 30 seconds has elapsed is determined, the CPU 10 ends the horizontal detection, bearing measurement and measurement value display (207). The series of CPU 10 operations are executed according to a content of a program stored in the ROM 11.

In this manner, the electronic wrist watch with a bearing detector in a bearing measurement mode can automatically start bearing measurement merely by being positioned in a horizontal state and, after lapse of a predetermined period of time, automatically ends the bearing measurement. This predetermined time was 30 seconds in the flowchart of FIG. 3, but can be arbitrary set and changed. Also, measurement of the predetermined time is performed using, for example, a built-in timer. That is, the predetermined time is set on this timer, and a count is started at a time point that a horizontal detection signal from the horizontal detection circuit 19 is inputted through the interrupt circuit 18 to the CPU 10. When the count value reaches the set predetermined value, a coincidence signal is generated to end the count. The coincidence signal is utilized as a measurement end signal.

In FIG. 4, if the electronic wrist watch with a bearing detector is rendered in a bearing measurement mode, the horizontal detection circuit 19 starts operation (301). The horizontal detection circuit 19, if when it detects a horizontal state, provides a horizontal detection signal to the interrupt circuit 18. The interrupt circuit 18 inputs the horizontal detection signal to the CPU 10. Thereupon, the CPU 10 determines that the electronic wrist watch with a bearing detector has been positioned in a horizontal state (302) and drives the display circuit 14 to perform horizontal state display (303). Next, the CPU 10 drives the bearing detection circuit 15 to perform bearing measurement (304) and further drives the display circuit 14 to perform bearing measurement value display (305). Subsequently, the CPU 10 determines whether measurement stop input has been made by the push button 17 or not (306). If there is no measurement stop input, the bearing measurement and measurement value display are continued. In the case that measurement stop input has been made by the push button 17, the CPU 10 ends the horizontal detection, bearing measurement and measurement value display (307). The series of CPU 10 operations are executed according to a content of a program stored in the ROM 11.

In this manner, the electronic wrist watch with a bearing detector according to the invention, in the bearing measurement mode, automatically starts a bearing measurement by merely being positioned in a horizontal state, and the bearing measurement can be ended also by pressing manually the push button 17 to generate a measurement stop signal.

Figure 6:
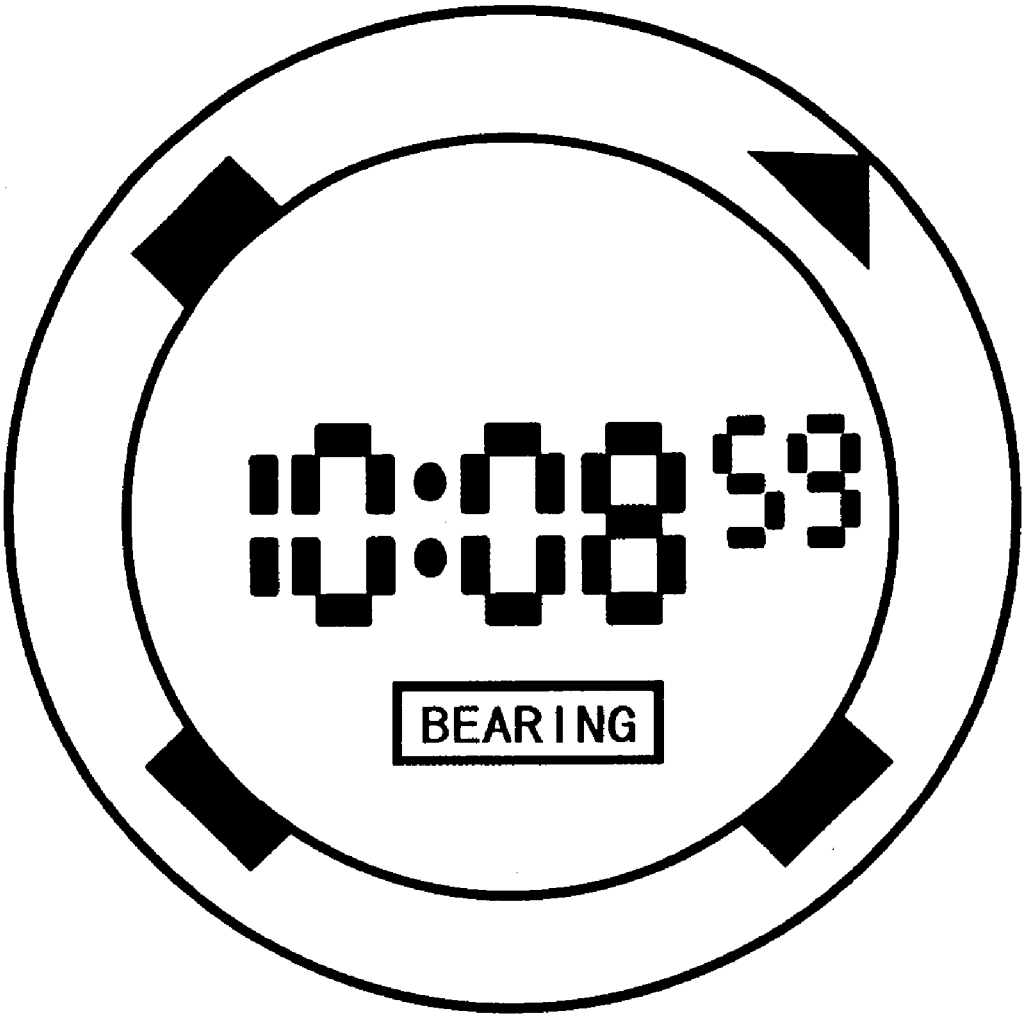
FIG. 6 is a figure showing one example of a display panel of the electronic wrist watch with a bearing detector.

FIG. 6 is a figure showing one example of a display panel used for the display circuit 14 of the electronic wrist watch with a bearing detector according to the present invention. The display panel is, for example, an LCD panel. The display panel of FIG. 6 has inner and outer display areas divided by larger and smaller two circles. The inner display area has time display in a center and horizontal state display thereunder. In FIG. 6, the time display exhibits 10:8:59 and the horizontal state display is indicated by characters of BEARING within a box. The horizontal state display may be other display instead of BEARING. In the outer display region, i.e. in a doughnut-formed area surrounded by the larger and smaller two circles, four bearing marks of a triangular mark indicative of north and three square marks indicative of west, east and south are displayed with an equal interval on a circumference. It is understood that the bearing marks can be other than the marks shown in FIG. 6.

By the present invention, bearing measurement could be automatically started by merely positioning the electronic wrist watch with an bearing detector in a horizontal state relative to the ground. Accordingly, because bearing measurement is made in a horizontal state, i.e. in a state parallel with the ground, the accuracy of a bearing measurement using an electronic wrist watch with a bearing detector. Also, because a bearing measurement push button is not required to be manually pressed to start a bearing measurement, the electronic wrist watch is easy for a wearer to utilize.

What is claimed is:

1. An electronic wrist watch with a bearing detector comprising:

a microprocessor;

a memory for storing a processing program for controlling the microprocessor and for storing processing data for performing processing operations;

an oscillation circuit for outputting a clock signal to the microprocessor to calculate time information;

a horizontal detection circuit for detecting a horizontal state of the electronic wrist watch relative to a ground reference;

bearing measurement means controlled by the microprocessor for performing a bearing measurement when a horizontal state of the electronic wrist watch relative to the around reference is detected by the horizontal detection circuit; and a display circuit driven by the microprocessor for displaying time information calculated by the microprocessor and for displaying bearing information obtained from a bearing measurement performed by the bearing measurement means.

2. An electronic wrist watch with a bearing detector according to claim 1; further comprising measurement stop signal generating means for generating a measurement stop signal for stopping a bearing measurement performed by the bearing measurement means; and wherein the bearing measurement means performs a bearing measurement until a measurement stop signal is inputted to the microprocessor.

3. An electronic wrist watch with a bearing detector according to claim 2; wherein the measurement stop signal generating means comprises a push button; and wherein the measurement stop signal is generated by manually pressing the push button.

4. An electronic wrist watch with a bearing detector according to claim 2; wherein the measurement stop signal generating means includes means for automatically generating the measurement stop signal after a predetermined time period has elapsed.

5. An electronic wrist watch with a bearing detector according to claim 1; further comprising a case having a chamber containing therein the microprocessor, the memory, the oscillation circuit, and the horizontal detection circuit.

6. An electronic wrist watch with a bearing detector according to claim 1; further comprising a case having a chamber containing therein the microprocessor, the memory and the oscillation circuit; and wherein the horizontal detection circuit is connected to an exterior surface of the case.

7. An electronic wrist watch with a bearing detector according to claim 1; wherein the horizontal detection circuit comprises a sensor having a container made of an insulation material, a pair of first conductive members disposed in a chamber of the container in spaced-apart relation to one another, and a second conductive member disposed in the chamber of the container for selectively placing the pair of first conductive members into and out of conductive contact with one another.

8. An electronic wrist watch with a bearing detector according to claim 7; wherein the pair of first conductive members are generally strip-shaped; and wherein the second conductive member comprises a movable spherical member for undergoing movement within the chamber of the container to selectively place the pair of first conductive members into and out of conductive contact with one another.

9. An electronic wrist watch with a bearing detector according to claim 7; wherein the second conductive member comprises a movable conductive member for undergoing movement within the chamber of the container to selectively place the pair of first conductive members into and out of conductive contact with one another.

10. An electronic wrist watch with a bearing detector according to claim 9; wherein the movable conductive member is generally spherical-shaped.

11. An electronic wrist watch with a bearing detector according to claim 7; wherein the container comprises a support member for supporting the pair of first conductive members, and a generally cup-shaped lid member for connection to the support member to define the chamber.

12. An electronic wrist watch with a bearing detector according to claim 11; wherein the support member has a first surface having a generally conical shape for supporting the pair of first conductive members in spaced-apart relation to define a space therebetween, and a second surface having a generally planar shape disposed opposite the first surface and defining an exterior surface of the case.

13. An electronic wrist watch with a bearing detector according to claim 4; further comprising a timer for counting the predetermined time period.

14. An electronic timepiece comprising:

oscillating means for producing a clock signal;

dividing means for dividing the clock signal and producing a divided output signal used to count elapsed time;

calculating means for calculating time information in accordance with the divided output signal produced by the dividing means;

detecting means for detecting a horizontal state of the electronic timepiece relative to a ground reference;

bearing measurement means for measuring bearing information when a horizontal state of the electronic timepiece relative to the ground reference is detected by the detecting means; and display means for displaying time information calculated by the calculating means and displaying bearing information measured by the bearing measurement means.

15. An electronic timepiece according to claim 14; further comprising stop signal generating means for generating a stop signal to stop measurement of bearing information by the bearing measurement means; and wherein the bearing measurement means includes means for measuring bearing information until a stop signal is generated by the stop signal generating means.

16. An electronic timepiece according to claim 15; wherein the stop signal generating means comprises a push button; and wherein a stop signal is generated by manually pressing the push button.

17. An electronic timepiece according to claim 15;

wherein the stop signal generating means includes means for automatically generating a stop signal after a predetermined time period has elapsed.

18. An electronic timepiece according to claim 17;

further comprising a timer for counting the predetermined time period.

19. An electronic timepiece according to claim 14; further comprising a case having a chamber containing therein the detecting means.

20. An electronic timepiece according to claim 14; further comprising a case having a chamber and an exterior surface; and wherein the detecting means is connected to the exterior surface of the case.

21. An electronic timepiece according to claim 14; wherein the detecting means comprises a sensor having a container made of an insulation material, a pair of first conductive members disposed in a chamber of the container in spaced-apart relation to one another, and a second conductive member disposed in the chamber for selectively placing the pair of first conductive members into and out of conductive contact with one another.

22. An electronic timepiece according to claim 21;

wherein the pair of first conductive members are generally strip-shaped; and wherein the second conductive member comprises a movable spherical member for undergoing movement within the chamber of the container to selectively place the pair of first conductive members into and out of conductive contact with one another.

23. An electronic timepiece according to claim 21; wherein the second conductive member comprises a movable conductive member for undergoing movement within the chamber of the container to selectively place the pair of first conductive members into and out of conductive contact with one another.

24. An electronic timepiece according to claim 23; wherein the movable conductive member is generally spherical-shaped.

25. An electronic timepiece according to claim 21; wherein the container comprises a support member for supporting the pair of first conductive members and a generally cup-shaped lid member for connection to the support member to define the chamber.

26. An electronic timepiece according to claim 25; wherein the support member has a first surface having a generally conical shape for supporting the pair of first conductive members in spaced-apart relation to define a space therebetween, and a second surface having a generally planar shape disposed opposite the first surface and defining an exterior surface of the case.

* * * * *